US010822797B2

(12) United States Patent
Natrajan et al.

(10) Patent No.: US 10,822,797 B2
(45) Date of Patent: Nov. 3, 2020

(54) MODULAR ROOM

(71) Applicant: Saint-Gobain Placo, Suresnes (FR)

(72) Inventors: Vinay Natrajan, Tamil Nadu (IN); Atul Koleshwar, Maharastra (IN); Unnikrishnan V. Painumgal, Tamil Nadu (IN)

(73) Assignee: Saint-Gobain Placo, Suresnes (FR)

( * ) Notice: Subject to any disclaimer, the term of this patent is extended or adjusted under 35 U.S.C. 154(b) by 0 days.

(21) Appl. No.: 16/316,619

(22) PCT Filed: Jul. 5, 2017

(86) PCT No.: PCT/IN2017/050272
§ 371 (c)(1),
(2) Date: Jan. 9, 2019

(87) PCT Pub. No.: WO2018/011820
PCT Pub. Date: Jan. 18, 2018

(65) Prior Publication Data

US 2019/0292778 A1 Sep. 26, 2019

(30) Foreign Application Priority Data

Jul. 12, 2016 (IN) ..... 201641023767

(51) Int. Cl.

| | |
|---|---|
| ***E04B 2/82*** | (2006.01) |
| ***E04B 2/74*** | (2006.01) |
| ***A47B 96/02*** | (2006.01) |
| ***A47B 96/04*** | (2006.01) |

(52) U.S. Cl.
CPC ..... *E04B 2/827* (2013.01); *A47B 96/02* (2013.01); *A47B 96/04* (2013.01); *E04B 2/7407* (2013.01)

(58) Field of Classification Search
CPC ..... E04B 2/827; E04B 2/7407; A47B 96/04
See application file for complete search history.

(56) References Cited

U.S. PATENT DOCUMENTS

| | | | | |
|---|---|---|---|---|
| 3,107,400 | A | 10/1963 | Anderson | |
| 5,090,171 | A * | 2/1992 | Kano | E04B 2/827 160/199 |
| 5,152,332 | A * | 10/1992 | Siener | E05F 15/605 160/188 |
| 5,167,575 | A * | 12/1992 | MacDonald | E04B 2/827 454/187 |
| 10,407,960 | B2 * | 9/2019 | Wolfe | E06B 3/509 |
| 2005/0252094 | A1 * | 11/2005 | Bischof | E05D 15/0608 52/7 |

(Continued)

FOREIGN PATENT DOCUMENTS

| | | | |
|---|---|---|---|
| DE | 1554206 | A1 | 3/1970 |
| DE | 202011052302 | U1 | 2/2012 |

OTHER PUBLICATIONS

International Search Report dated Nov. 20, 2017 of PCT/IN2017/050272 filed Jul. 5, 2017, 1 page.

*Primary Examiner* — Paola Agudelo
(74) *Attorney, Agent, or Firm* — McDonnell Boehnen Hulbert & Berghoff LLP

(57) ABSTRACT

A movable drywall is provided. The movable drywall includes a supporting member and a pair of wings operatively coupled to the supporting member. The pair of wings is configured to move relative to the supporting member.

22 Claims, 8 Drawing Sheets

(56) References Cited

U.S. PATENT DOCUMENTS

2005/0257437 A1* 11/2005 Juten ..... G06Q 10/087
52/36.1
2006/0248826 A1* 11/2006 Owens ..... E04B 2/827
52/243.1
2009/0199491 A1* 8/2009 Boldt ..... E05F 15/649
52/64
2009/0250176 A1* 10/2009 Ryan ..... E04B 2/7425
160/185
2010/0263802 A1* 10/2010 Juan ..... E04B 2/827
160/120
2012/0012259 A1* 1/2012 Goodman ..... E05F 15/643
160/127
2013/0025220 A1* 1/2013 Yu ..... E04C 2/52
52/220.7
2014/0013668 A1* 1/2014 Balbach ..... E05D 15/0652
49/409
2015/0033642 A1* 2/2015 Johnson ..... E04B 2/827
52/173.1
2015/0284949 A1* 10/2015 Hilliaho ..... E06B 3/924
52/204.1
2017/0328105 A1* 11/2017 Malejko ..... E05D 15/0626

* cited by examiner

MODULAR ROOM

This application is a U.S. national phase application of International Patent Application no. PCT/IN2017/050272, filed Jul. 5, 2017, which claims the benefit of priority of Indian Patent Application No. 201641023767, filed Jul. 12, 2016.

TECHNICAL FIELD

The present disclosure relates to a modular room, and more specifically to a wall system for the modular room.

BACKGROUND

Typically buildings such as, homes, hospitals, office spaces may be constructed with a predefined number of rooms. However, in some cases, the predefined number of rooms may not be sufficient for a user. In order to extend the number of rooms or convert a single room into multiple rooms, conventional methods include breaking of one or more structures, for example, walls of the room, adjusting the furniture and other components of the buildings. Such process may be tedious, time consuming and may result in loss of material due to breaking of existing walls or other parts of the buildings.

Moreover, such modifications in the room structure are permanent and it may not be possible to dynamically change the configuration of the room into multiple rooms or revert back to a single room. Other known methods include providing a movable partition that is used to partition the rooms into two pre-defined spaces. However, such a configuration may not provide a closed room. Therefore, there exists a need for a solution that addresses the problems discussed above.

For reference, U.S. patent application no. 2005/0257437 is generally directed to a modular space in a building construction with a method and system for making the modular space, and more particularly to a modular room comprising custom designed and prefabricated components.

SUMMARY OF THE DISCLOSURE

In one aspect of the present disclosure, a movable drywall is provided. The movable drywall includes a supporting member and a pair of wings operatively coupled to the supporting member. The pair of wings is configured to move relative to the supporting member.

In another aspect of the present disclosure, a modular wall system for a room having a ceiling and a plurality of sidewalls is provided. The modular wall system includes a support structure configured to be coupled to the ceiling of the room. The modular wall system also includes a modular wall movably coupled to the support structure. The modular wall includes a supporting member and a pair of wings operatively coupled to the supporting member. Each of the wings is configured to move towards an open position and a closed position. The wings are configured to move towards the corresponding sidewall in the open position. The modular wall with the pair of wings in the open position is configured to divide the room into at least two rooms.

In yet another aspect of the present disclosure, a modular room is provided. The modular room includes a plurality of sidewalls and at least one drywall. The at least one drywall defines a vertical axis along a height thereof, a first axis along a length thereof, and a second axis perpendicular to each of the vertical axis and the first axis. The at least one drywall is configured to move parallel to the second axis to a moved position. The at least one drywall includes a supporting member and a pair of wings operatively coupled to the supporting member. Each of the wings is configured to move towards an open position and a closed position. Each of the wings is configured to move towards the corresponding sidewall of the plurality of sidewalls in the open position. The plurality of sidewalls, the at least one drywall in the moved position and the pair of wings in the open position are configured to form at least two rooms within the modular room.

In another aspect of the present disclosure, a modular wall for a room having a plurality of sidewalls is provided. The modular wall includes a supporting member and a pair of wings operatively coupled to the supporting member. Each of the wings is configured to move to an open position and a closed position. The pair of wings is configured to move to the open position, towards a corresponding sidewall of the plurality of sidewalls.

Other features and aspects of this disclosure will be apparent from the following description and the accompanying drawings.

BRIEF DESCRIPTION OF THE DRAWINGS

Embodiments are illustrated by way of example and are not limited in the accompanying figures.

Skilled artisans appreciate that elements in the figures are illustrated for simplicity and clarity and have not necessarily been drawn to scale. For example, the dimensions of some of the elements in the figures may be exaggerated relative to other elements to help to improve understanding of embodiments of the invention.

DETAILED DESCRIPTION

Figure 1:
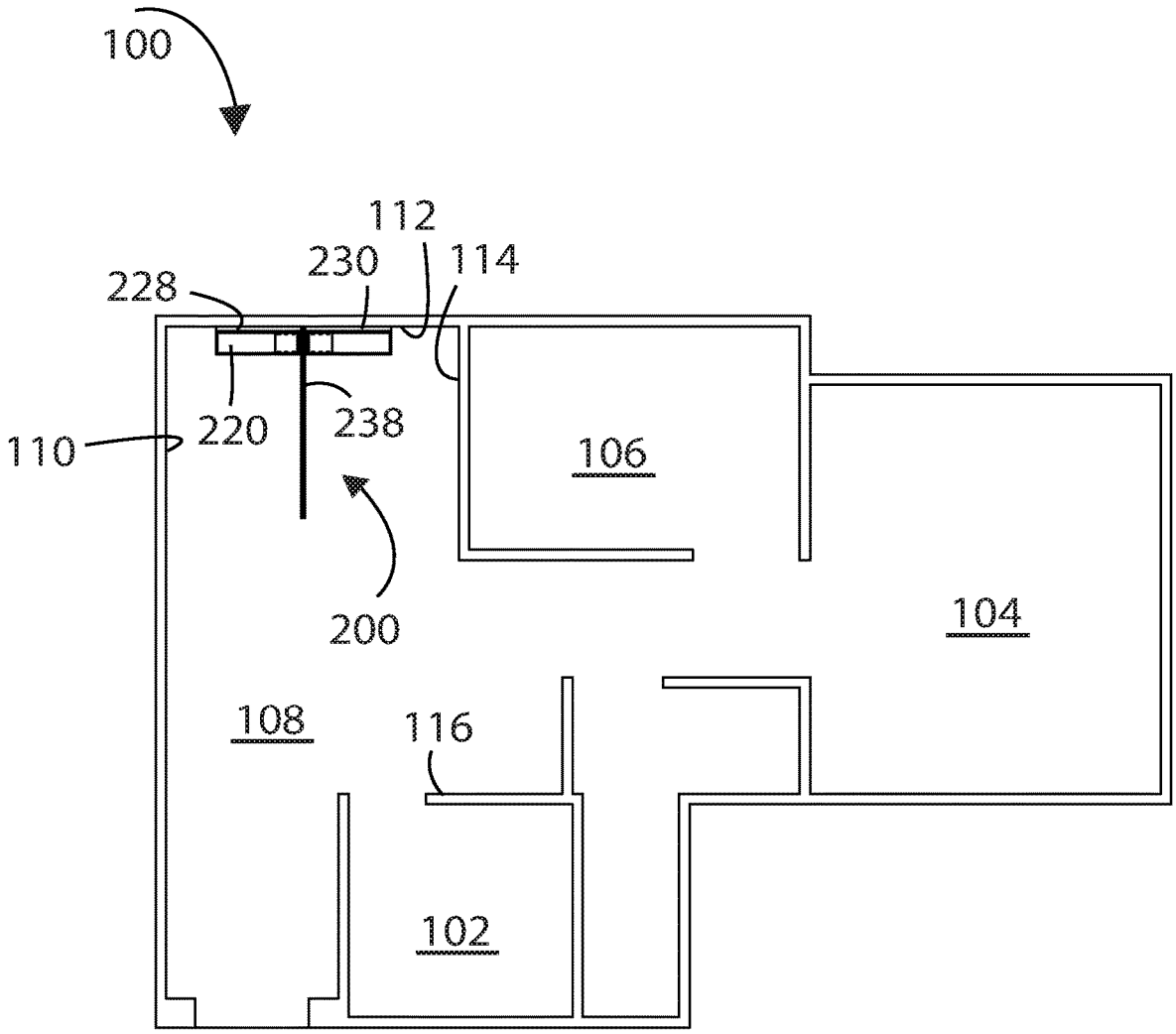
FIG. 1 illustrates an exemplary modular home, in accordance with an embodiment of the present disclosure.

Wherever possible, the same reference numbers will be used throughout the drawings to refer to the same or the like parts. Embodiments disclosed herein are related to modular rooms and wall systems that may be used to render the feature of modularity to the rooms. FIG. 1 illustrates an exemplary modular home 100, in accordance with an embodiment of the present disclosure. In the illustrated example, the modular home 100 includes four rooms 102, 104, 106, 108. The room 108 will be explained hereinafter as the modular room 108, according to an embodiment of the present disclosure. However, it may be contemplated to implement the concepts of the modular room 108 in any of the rooms of the modular home 100 or rooms of other homes, office spaces, hospitals, and the like.

In the illustrated embodiment, the modular room 108 includes four sidewalls 110, 112, 114 and 116. Further, each of the sidewalls 114 and 116 may define an opening. In an example, a movable door (not shown) may be disposed in at least one of the opening defined in the respective sidewalls 114 and 116. In other embodiments, any of the sidewalls 110, 112, 114 and 116 may define the opening. Although, the modular room 108 is illustrated and described to include the four sidewalls 110, 112, 114 and 116, it may be recognized that the modular room 108 may include any number of sidewalls so as to form the modular room 108 there between. In an example, the modular room 108 may have more than four sidewalls and have a polygonal shape. In another example, the modular room 108 may have three sidewalls and have a triangular shape.

The modular room 108 further includes a ceiling 118 disposed on the sidewalls 110, 112, 114 and 116. In the illustrated embodiment, the ceiling 118 (shown in FIG. 2) may be a false ceiling disposed below a roof of the modular home 100. In another embodiment, the ceiling 118 may be the roof of the modular home 100.

Figure 2:
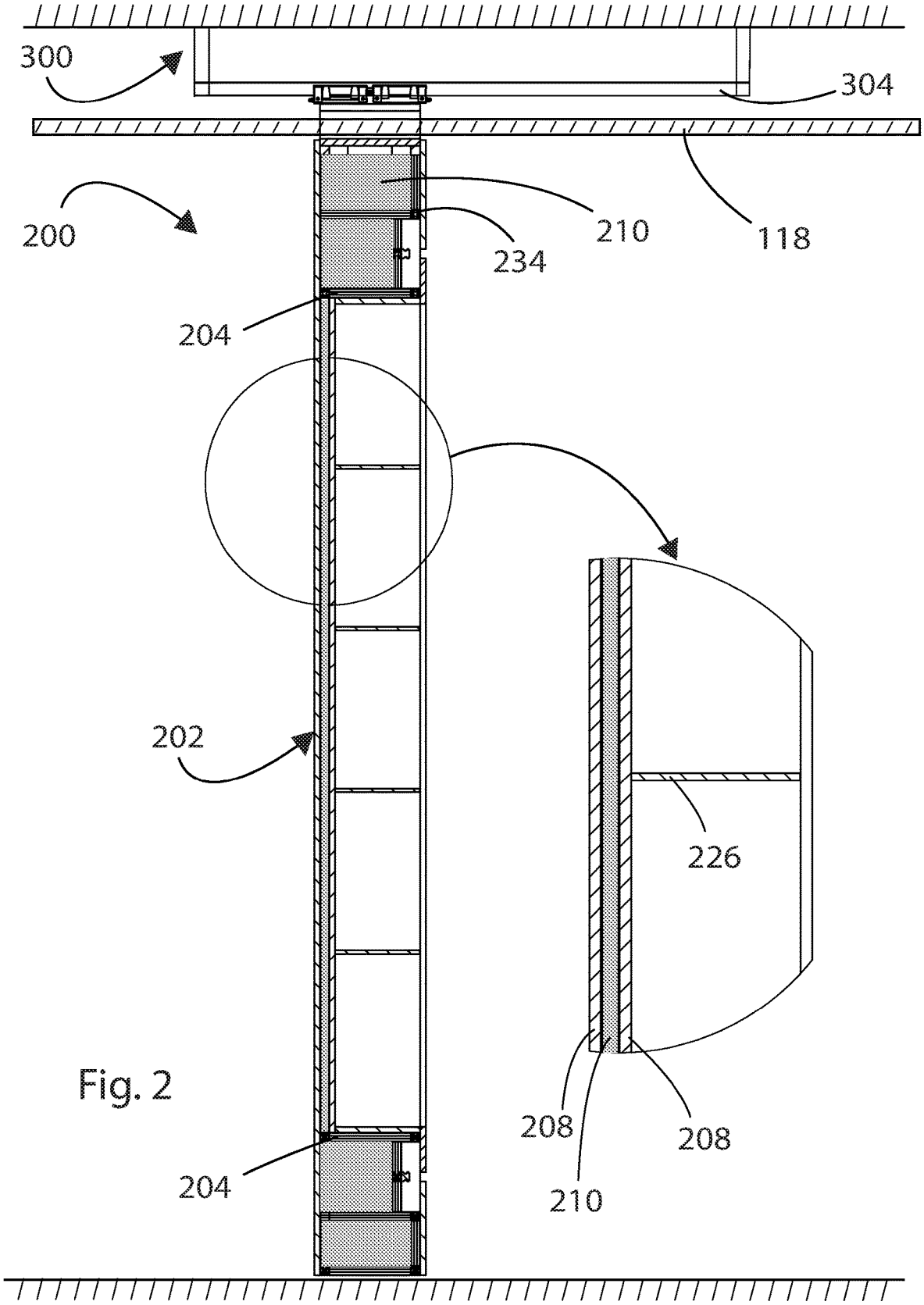
FIG. 2 illustrates a sectional view of a modular wall system of an exemplary room of a modular home, according to an embodiment of the present disclosure.

Referring to FIGS. 1 and 2, the modular room 108 includes a modular wall system 200, according to an embodiment of the present disclosure. The modular wall system 200 includes a modular wall 202 disposed in the modular room 108. In the illustrated embodiment of FIG. 2, the modular wall 202 is a movable drywall. The drywall 202 may include a frame 204. In an example, the frame 204 may be a metal frame. In other examples, the frame 204 may include other suitable materials such as, but not limited to, plastic, wood and the like. The frame 204 may include multiple cross-beams (not shown) attached between sides of the frame 204. The drywall 202 also includes a gypsum panel 208 attached on each of the sides of the frame 204.

The drywall 202 may also include at least one insulation element 210. In the illustrated embodiment, the insulation element 210 is disposed between the frame 204 and the gypsum panels 208. In an example, the insulation element 210 may include a foam material. In other embodiments, the insulation element 210 may be disposed at other locations in the drywall 202 based on a specific type of application. Alternatively, the drywall 202 may be configured without the insulation element 210.

It may be preferable for one or more components of the modular wall 202 to be reinforced. In an example, the supporting member 220 and the wings 228 and 230 may be reinforced. Such an embodiment of the invention may be preferable to improve the racking resistance of the gypsum panel 208. Preferably, the gypsum panel 208 may comprise a polymeric binder and plurality of fibres. Such a feature may be preferable as it may provide reinforcement to the gypsum panel 208. Preferably, said plurality of fibres may comprise glass fibres, synthetic polymer fibres or natural fibres, either separately or in combination.

Preferably, said polymeric binder and said plurality of fibres, in combination, comprise greater than 1% by weight of the gypsum panel 208. Such an embodiment of the invention may be preferable as it may increase the strength of the modular wall 202. Preferably, the polymeric binder may comprise greater than 1% by weight of the gypsum panel 208. Preferably, the fibres may comprise greater than 1% by weight of the gypsum panel 208.

It may be preferable for the polymeric binder to comprise starch. It may also be preferable for the polymeric binder to comprise a synthetic material. More preferably, the synthetic polymeric binder may comprise polyvinyl acetate.

Preferably, the gypsum panel 208 may be a Habito (registered trade mark) board.

However, in various other embodiments, various components of the modular wall 202 may be made of any other materials such as, but not limited to, MDF, plywood, glass, metal sheet, cement, fiber cement and plastic sheet.

The modular wall 202 and the modular wall system 200 will be explained hereinafter with reference to FIGS. 3 and 4. The modular wall 202 may have a length 'L1' and a height 'H1' in a plane 212 of the modular wall 202. The modular wall 202 defines a vertical axis 214 along the height 'H1' and a first axis 216 along the length 'L1'. The modular wall 202 further defines a second axis 218 perpendicular to each of the vertical axis 214 and the first axis 216. In the illustrated embodiment, the modular wall 202 is disposed adjacent to the sidewall 112 and parallel to the first axis 216. Further, the modular wall 202 is also disposed in between the sidewalls 110 and 114.

The modular wall 202 includes a supporting member 220 having a first side 222 and a second side 224. In the illustrated embodiment, the supporting member 220 may include multiple shelves 226 that are disposed on the first side 222 of the supporting member 220. Further, the first side 222 of the supporting member 220 may face the sidewall 112. In another embodiment, the shelves 226 may be disposed on the second side 224 of the supporting member 220. Alternatively, the supporting member 220 may further include shelves 226 that are disposed on both the first side 222 and second side 224 of the supporting member 220.

A person of ordinary skill in the art will recognize that a design and/or configurations of the shelves 226 are merely exemplary in nature and hence non-limiting of this disclosure. Moreover, the supporting member 220 may or may not include other types of shelves 226 or components.

The modular wall 202 also includes a pair of wings 228 and 230 slidably attached to the supporting member 220. In the illustrated embodiment of FIG. 3, the wings 228 and 230 are attached to the first side 222 of the supporting member 220. As such, the wings 228 and 230 may act as doors for the shelves 226 of the supporting member 220. In another embodiment, the wings 228 and 230 may be attached to the second side 224 of the supporting member 220.

Figure 3:
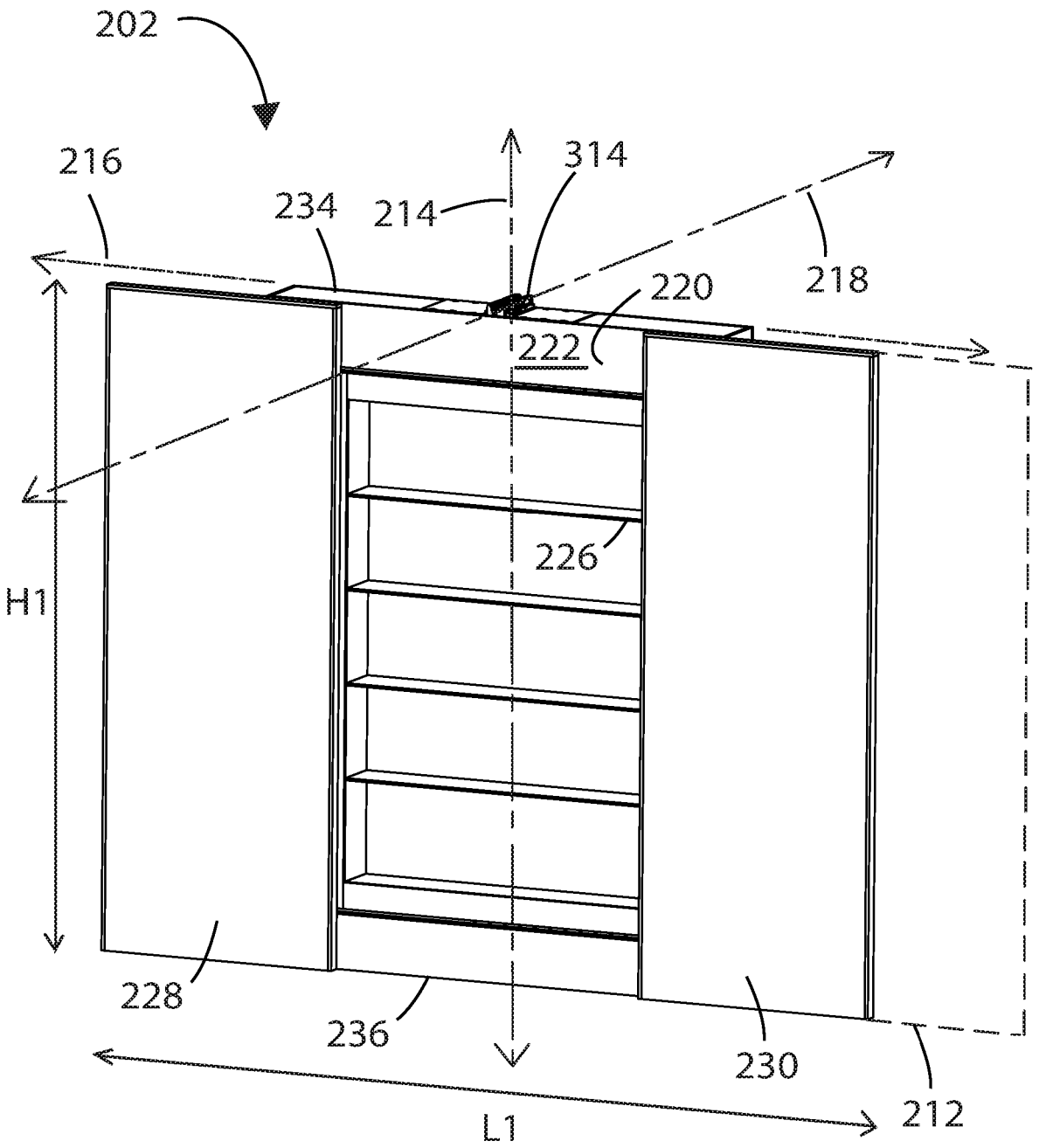
FIG. 3 illustrates a perspective view of a modular wall of a modular wall system, according to an embodiment of the present disclosure.

In the illustrated embodiment of FIG. 3, the modular wall 202 includes a supporting member 220 disposed in the plane 212. The modular wall 202 further includes a pair of wings 228 and 230 operatively coupled to the supporting member 220. In the illustrated embodiment, the wings 228 and 230 may be slidably attached to the supporting member 220 so as to slide along the plane 212. In an example, each of the wings 228 and 230 may be coupled to the supporting member 220 via an elongate member (not shown) having an I-shape. Further, one side of the elongate member may be attached to the corresponding wings 228, 230 and the other side of the elongate member may be attached to the supporting member 220 via a track disposed in the supporting member 220. As such, the wings 228 and 230 may slide along the track.

In another embodiment, the modular wall 202 may include a receiving member (not shown) attached to the supporting member 220 adjacent to a top end 234 and a bottom end 236 of the modular wall 202 thereof. Further, each of the wings 228 and 230 may include a track member 238 corresponding to each of the receiving member. As such, the receiving member may slide inside the track member 238 to enable the wings 228 and 230 to slide parallel to the first axis 216.

Figure 4:
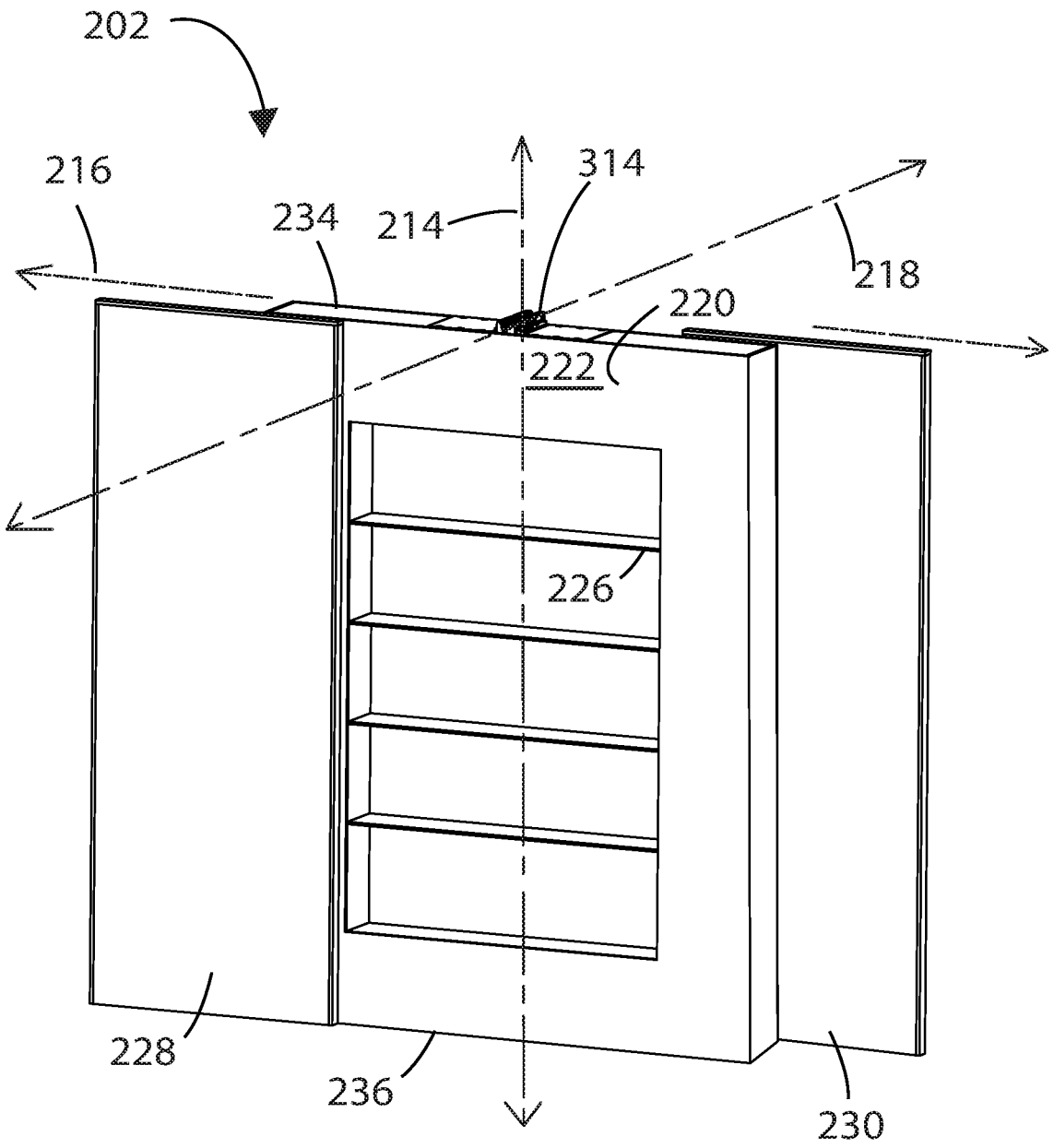
FIG. 4 illustrates a perspective view of a modular wall of a modular wall system, according to another embodiment of the present disclosure.

In yet another embodiment, the supporting member 220 may define a recess in each of the sides of the supporting member 220, as illustrated in FIG. 4. The wings 228 and 230 may be configured to be slidably received in the corresponding recesses, at least partially. With such an implementation, both the first and second sides 222 and 224 of the modular wall 202 remain accessible with the wings 228 and 230 either in open position or closed position. As such, the shelves or other features may be suitably enabled on any of the sides 222, and/or 224 of the modular wall 202.

In another embodiment, the wings 228 and 230 may be rotatably coupled to the supporting member 220 so as to fold out from the supporting member 220. In an example, the wings 228 and 230 may be coupled to the supporting member 220 by hinges. In another embodiment, the wings 228 and 230 may have a concertina arrangement. It may also be contemplated to use other mechanisms to accomplish the coupling between the wings 228, 230 and the supporting member 220.

Figure 5:
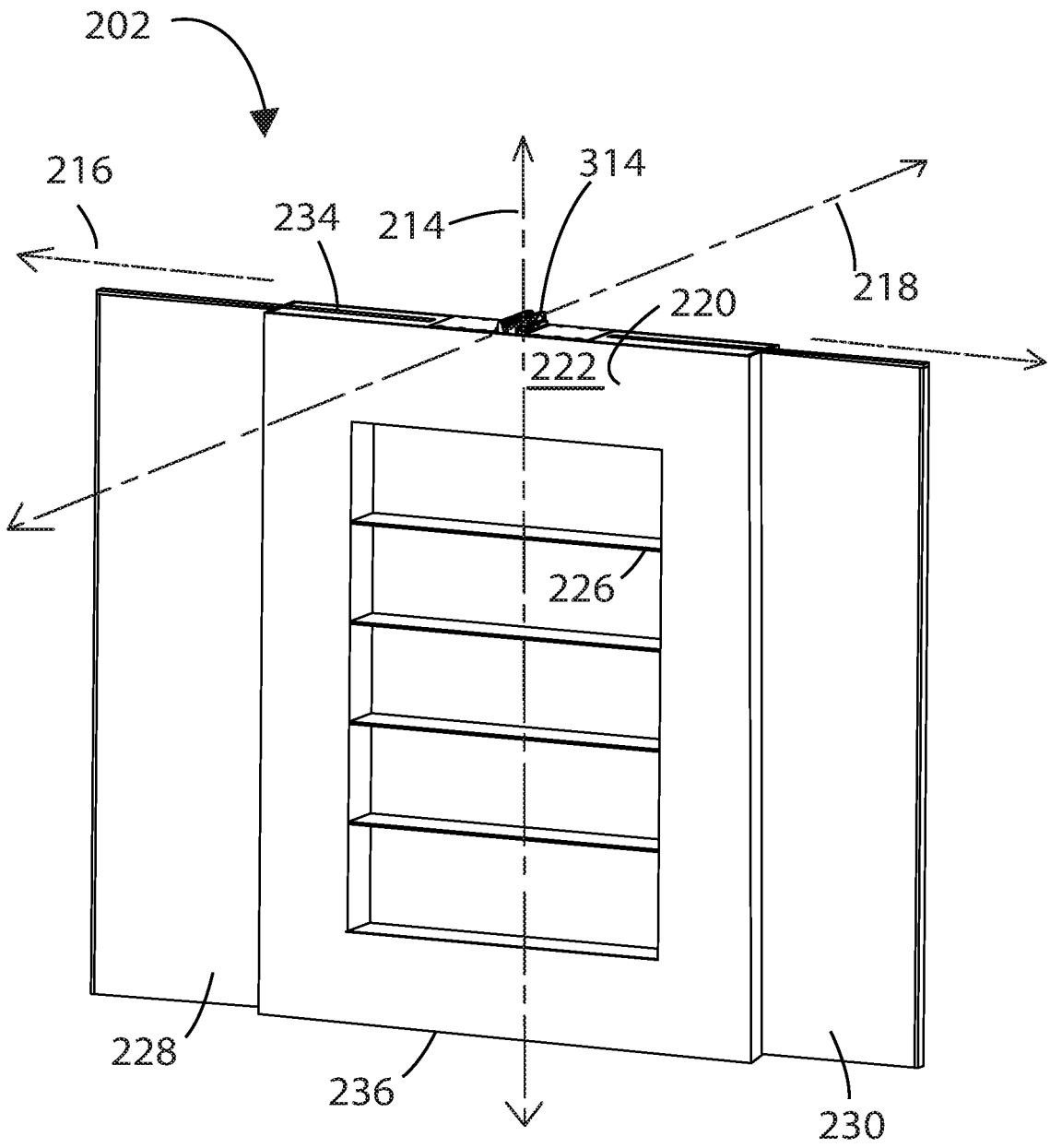
FIG. 5 illustrates a perspective view of a modular wall of a modular wall system, according to yet another embodiment of the present disclosure.

In another embodiment, one of the wings 228 or 230 may be attached to the first side 222 and the other of the wing 228 or 230 may be attached to the second side 224, as illustrated in FIG. 5. However, in other embodiments, the modular wall 202 may also include multiple pairs of wings 228, 230 that may be attached to each of the first and second sides 222 and 224 of the supporting member 220.

Each of the wings 228, 230 is configured to move towards an open position and a closed position. Further a combined length 'L1' of the modular wall 202 having the wings 228, 230 in the open position may be substantially equal to the distance between the sidewalls 110, 114 between which the modular wall 202 is disposed. As such, the wings 228, 230 may move towards the sidewalls 110, 114 respectively while moving towards the open position. In the illustrated embodiment, the wings 228, 230 may contact the sidewalls 110, 114 respectively in the open position.

In another embodiment, the modular wall 202 may include one or more secondary wings (not shown) coupled to each of the wings 228 and 230. The secondary wings may either be slidably or rotatably coupled to the corresponding wings 228 and 230. As such, to obtain the open position, each of the secondary wings and the wings 228, 230 may have to be unfolded.

In the illustrated embodiment, the modular wall 202 is disposed parallel to the first axis 216. In other embodiments, the modular wall 202 may be suitably disposed at an angle with the first axis 216. In an example, the modular wall 202 may be disposed at an angle of 90 degrees to the first axis 216 based on the shape of the modular room 108.

In other examples, as discussed above, the modular wall 202 may be disposed in various other configurations and shapes of the rooms. In such cases, a size, a shape and a configuration of the supporting member 220 and/or the wings 228, 230 may vary to suit the requirements of the application. Accordingly, the wings 228, 230 in the open position may substantially contact the corresponding sidewalls 110, 112, 114, 116.

In yet another example, each of the wings 228, 230 may further include an additional wing slidably coupled thereto. As such, in the open position of both the additional wings and the wings 228, 230, the additional wings may contact the corresponding sidewalls 110, 112, 114, 116.

Further, the modular wall 202 is configured to move parallel to the second axis 218. In an embodiment, the modular wall 202 may also be configured to rotate about the vertical axis 214. In yet another embodiment, the modular wall 202 may be configured to rotate about the first axis 216. As such, the modular wall 202 may be flipped against the ceiling 118.

Figure 6:
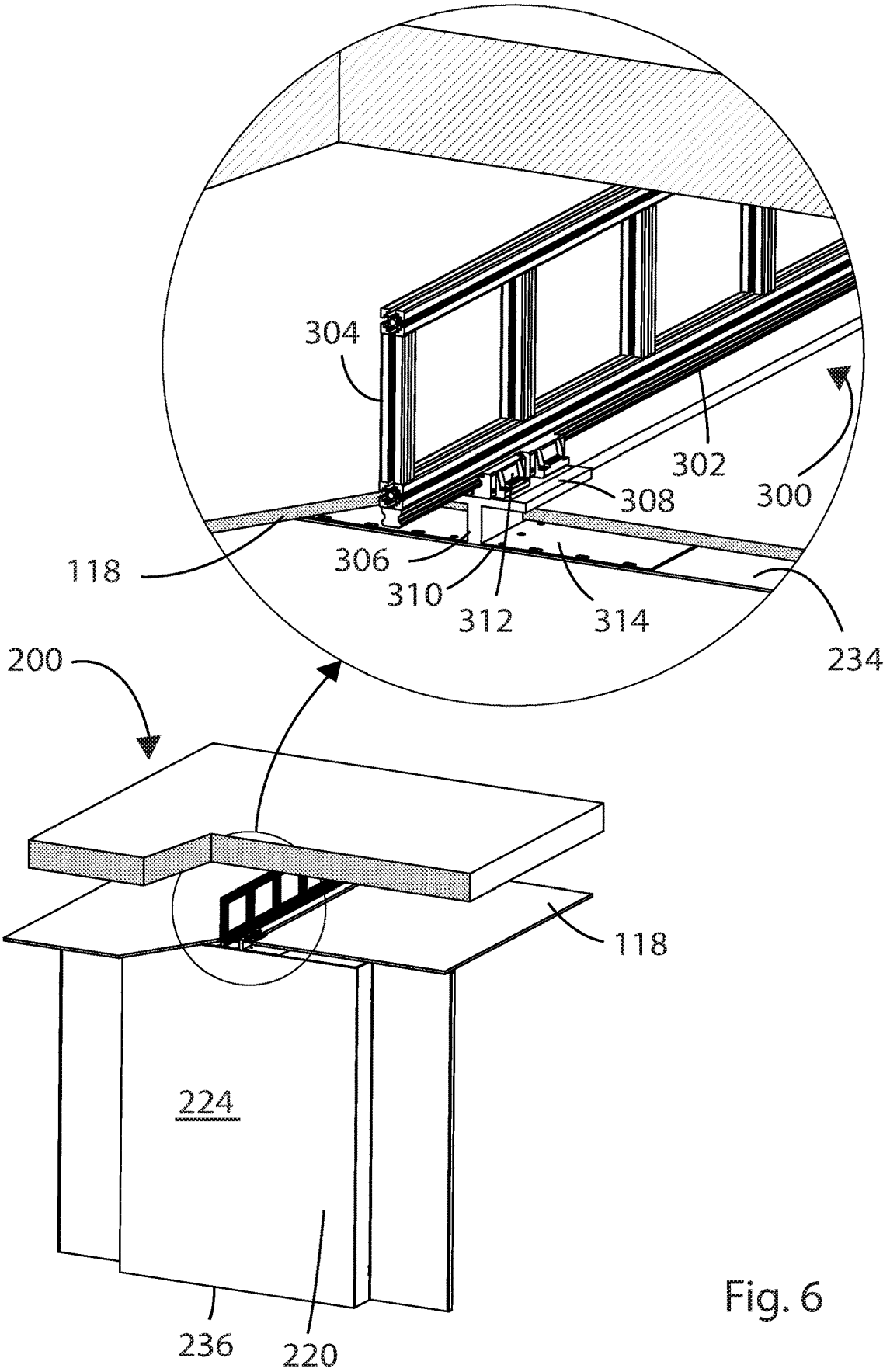
FIG. 6 illustrates a perspective view of a modular wall system showing a support structure, according to an embodiment of the present disclosure.

Referring to FIG. 6, the modular wall system 200 may also include a support structure 300. The modular wall 202 may be movably coupled to the support structure 300. Further, the support structure 300 is configured to be coupled to the ceiling 118 of the modular room 108.

In one embodiment, the support structure 300 may include a rail member 302 disposed parallel to the second axis 218 and coupled to the ceiling 118. As shown, the rail member 302 may be coupled to the ceiling 118 via an overhanging structure 304. The overhanging structure 304 may be coupled to the ceiling 118. Further, the overhanging structure 304 may include multiple bars coupled to each other via fasteners. Alternatively, at least some of the bars of the overhanging structure 304 may be welded to each other.

The support structure 300 may also include an elongate member 306 having a first end 308 and a second end 310. As shown, the elongate member 306 may have an I-shape. The first end 308 may be slidably received in the rail member 302. The support structure 300 may also include a first flange member 312 that is coupled to the first end 308 of the elongate member 306. The support structure 300 further includes a second flange member 314 coupled to the first flange member 312. Each of the first and second flange members 312 and 314 may have a plate configuration. Further, the second flange member 314 may be coupled to the top end 234 of the modular wall 202. With such an implementation, the modular wall 202 may be moved parallel to the rail member 302.

The coupling between the first and second flange members 312 and 314 may be accomplished by using any suitable methods such as, but not limited to fasteners, welding and the like. Further, the first flange member 312 and the second flange member 314 may be coupled to the second end 310 of the elongate member 306 and the top end 234 of the modular wall 202 respectively, by any suitable methods such as, but not limited to fasteners such as, threaded screws or bolts, studs, welding and the like.

In other embodiments, the support structure 300 may include multiple rail members 302 disposed parallel to each other. The support structure 300 may also include multiple elongate members 306 that may be slidably received in the corresponding rail members 302. Further, the elongate members 306 may be coupled to the top end 234 of the modular wall 202 at different locations.

In another embodiment, the elongate member 306 may include a rotatable member (not shown) disposed between the first end 308 and the second end 310. The rotatable member (not shown) may be a circular member rotatably coupled to the elongate member 306 adjacent to the second end 310. As such, the modular wall 202 may rotate about the vertical axis 214.

Although, the elongate member 306 is illustrated to have an I-shape, it may be envisioned to use the elongate member 306 of any other shape. Accordingly, the first end 308 of the elongate member 306 may be slidably received in the rail member 302. Further, the second end 310 of the elongate member 306 may be directly or indirectly coupled to the top end 234 of the modular wall 202.

Additionally or optionally, the support structure may also include floor tracks (not shown) attached to the bottom end 236 of the modular wall 202. The floor tracks may include any of the rails, wheels and the like that can enable the modular wall 202 to translate and/or rotate about the vertical axis 214.

A person of ordinary skill in the art will understand that the configuration of the support structure 300 as described herein is merely exemplary in nature and hence non-limiting of this disclosure. Moreover, the modular wall system 200 may include any type and/or configuration of the support structure 300 that may enable the movement of the modular wall 202 along the second axis 218. Further, the modular wall system 200 may alternatively include one or more structures to enable the modular wall 202 to rotate about at least one of the first axis 216 and the vertical axis 214.

Figure 7:
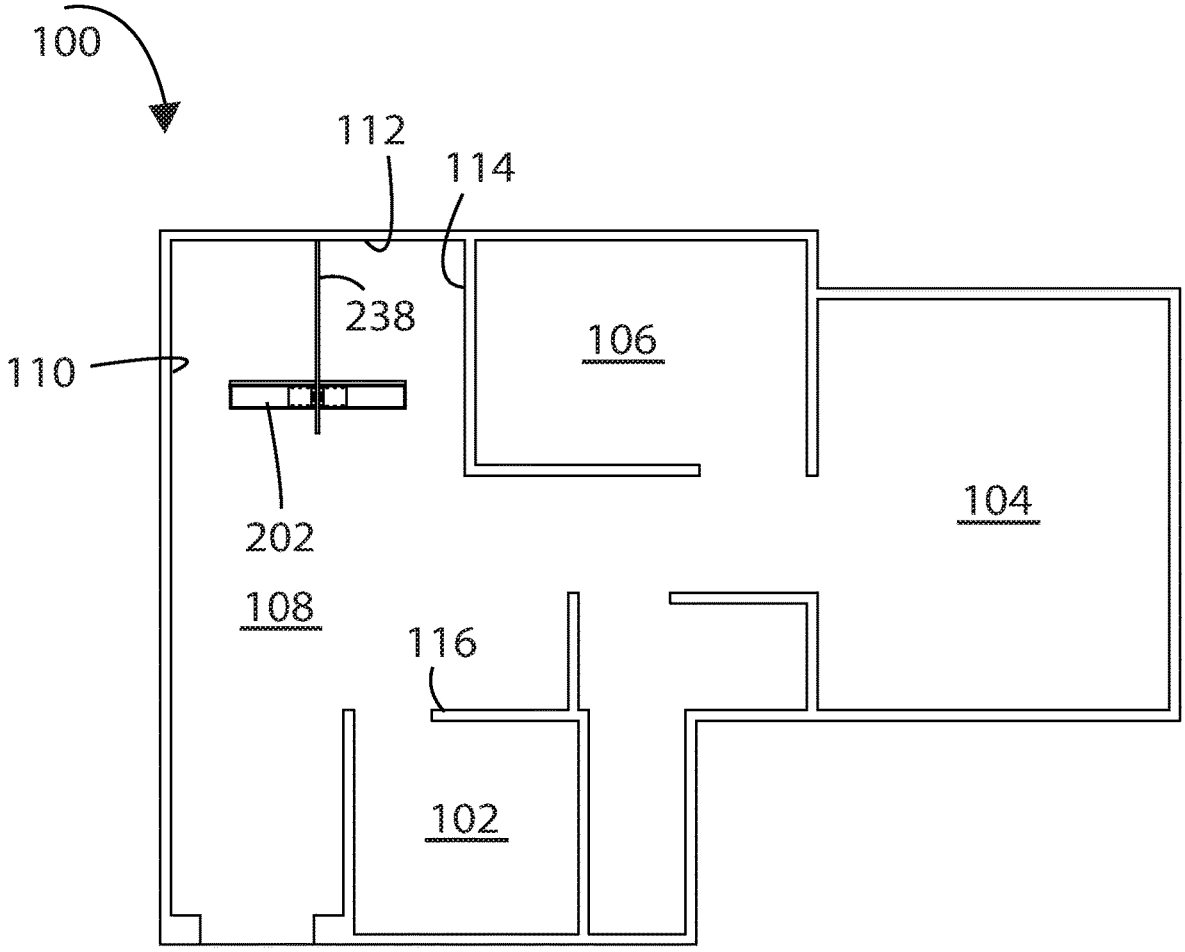
FIG. 7 illustrates a plan view of a modular room showing a modular wall being moved to a moved position, in accordance with an embodiment of the present disclosure.
Figure 8:
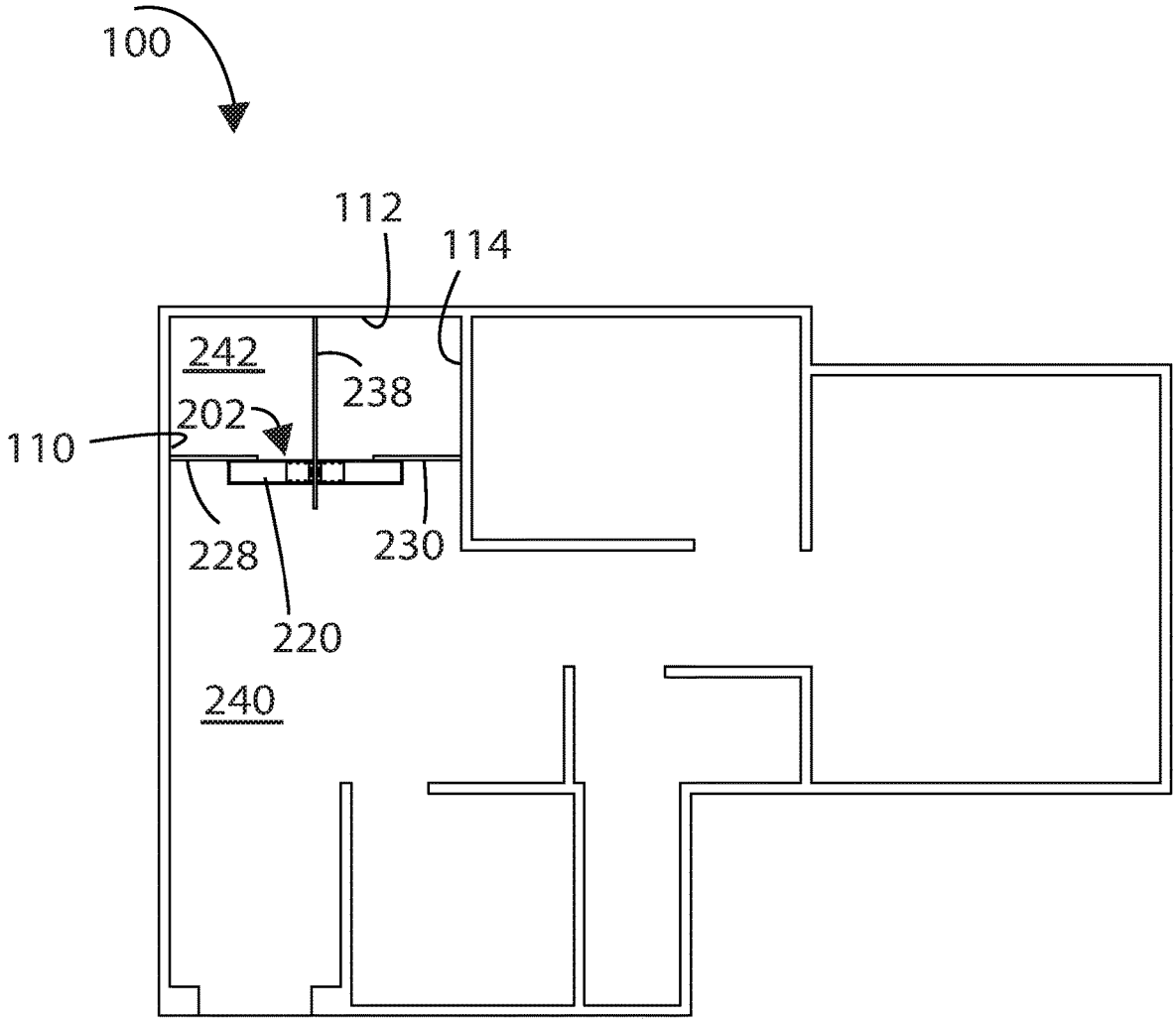
FIG. 8 illustrates a plan view of a modular room with a modular wall in the moved position and a pair of wings in the open position, in accordance with an embodiment of the present disclosure.

Referring back to FIG. 1, the modular wall 202 is disposed against the sidewall 112 and further, the wings 228 and 230 are in the closed position. Referring now to FIG. 7, the modular wall 202 being moved to a moved position is illustrated. Referring to FIG. 8, the modular room 200 divided into two rooms 240 and 242 by the modular wall 202 is illustrated. In the moved position, the modular wall 202 may be at a distance from the sidewall 112. The distance may be chosen based on a ratio of sizes that may be desired for the rooms 240 and 242. As shown, the modular wall 202 may be moved parallel to the second axis 218 in the moved position.

Referring to FIG. 8, the modular wall 202 with the wings 228 and 230 in the open position is illustrated. Each of the wings 228 and 230 may be slid parallel to the first axis 216 in the open position. In one embodiment, the wings 228 and 230 may include a handle (not shown) disposed thereon. Accordingly, the wings 228 and 230 may be at least partially moved towards the open position using the respective handles. Further as shown, in the open position the wings 228 and 230 may substantially contact the corresponding sidewalls 110 and 114, respectively. With such a configuration, the modular room 108 includes two rooms 240 and 242. As can be seen from FIG. 8, the room 242 formed with the modular wall 202, and the sidewalls 110, 112, 114 have a closed configuration.

In various other embodiments, the modular room 108 may include more than one modular wall 202. Accordingly, the modular room 108 may be divided into more than two rooms. For example, the modular room 108 may include an additional wall disposed against one of the sidewalls 110 or 114. Referring to FIG. 8, the additional wall may be moved parallel to the first axis 216. Further, the corresponding wings 228, 230 of the additional modular wall may be slid to the open position so as to divide the room 242 into two other rooms. As such, the modular room 108 with two modular walls 202 may be divided into three rooms.

INDUSTRIAL APPLICABILITY

With use and implementation of the movable drywall 202 and the modular wall system 200 of the present disclosure, any of the rooms may be converted into at least two rooms. In one configuration, the second side 224 of the supporting member 220 may be disposed against one of the sidewalls 110, 112, 114, 116 and the wings 228, 230 may be disposed in the closed position. Further, various components such as, a television, decorative items or the like may be disposed on the first side 222 of the supporting member 220. In such a configuration, the modular wall 202 may form part of the modular room 108 without interfering with other components of the modular room 108. In other configuration, the modular wall 202 may be moved parallel to the second axis 218 to a certain position and the wings 228, 230 may be moved to the open position to obtain two rooms. Moreover, furniture in the modular room 108 may be arranged such that the movement of the modular 202 may be achieved without moving the furniture.

Further, the wings 228, 230 of the modular wall 202 in the open position are configured to contact the corresponding sidewalls 110, 114 of the modular room 108. As such, at least one closed room may be obtained. Moreover, the use of drywall 202 in dividing the modular room 108 into multiple rooms may render various properties to the divided room such as acoustic properties, insulation, aesthetics and the like.

Note that not all of the activities described above in the general description or the examples are required, that a portion of a specific activity may not be required, and that one or more further activities may be performed in addition to those described. Still further, the order in which activities are listed is not necessarily the order in which they are performed.

Benefits, other advantages and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims.

The specification and illustrations of the embodiments described herein are intended to provide a general understanding of the structure of the various embodiments. The specification and illustrations are not intended to serve as an exhaustive and comprehensive description of all of the elements and features of apparatus and systems that use the structures or methods described herein. Certain features, that are for clarity, described herein in the context of separate embodiments, may also be provided in combination in a single embodiment. Conversely, various features that are, for brevity, described in the context of a single embodiment, may also be provided separately or in a sub combination. Further, reference to values stated in ranges includes each and every value within that range. Many other embodiments may be apparent to skilled artisans only after reading this specification. Other embodiments may be used and derived from the disclosure, such that a structural substitution, logical substitution, or another change may be made without departing from the scope of the disclosure. Accordingly, the disclosure is to be regarded as illustrative rather than restrictive.

The description in combination with the figures is provided to assist in understanding the teachings disclosed herein, is provided to assist in describing the teachings, and should not be interpreted as a limitation on the scope or applicability of the teachings. However, other teachings can certainly be used in this application.

As used herein, the terms "comprises," "comprising," "includes," "including," "has," "having" or any other variation thereof, are intended to cover a non-exclusive inclusion. For example, a method, article, or apparatus that comprises a list of features is not necessarily limited only to those features but may include other features not expressly listed or inherent to such method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

Also, the use of "a" or "an" is employed to describe elements and components described herein. This is done merely for convenience and to give a general sense of the scope of the invention. This description should be read to include one or at least one and the singular also includes the plural, or vice versa, unless it is clear that it is meant otherwise. For example, when a single item is described herein, more than one item may be used in place of a single item. Similarly, where more than one item is described herein, a single item may be substituted for that more than one item.

Unless otherwise defined, all technical and scientific terms used herein have the same meaning as commonly understood by one of ordinary skill in the art to which this invention belongs. The materials, methods, and examples are illustrative only and not intended to be limiting. To the extent that certain details regarding specific materials and processing acts are not described, such details may include conventional approaches, which may be found in reference books and other sources within the manufacturing arts.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of what is disclosed. Such embodiments should be understood to fall within the scope of the present disclosure as determined based upon the claims and any equivalents thereof.

LIST OF ELEMENTS

100 Modular Home
102 Room
104 Room
106 Room
108 Room/Modular Room
110 Sidewall
112 Sidewall
114 Sidewall
116 Sidewall
118 Ceiling
200 Modular Wall System
202 Modular Wall
204 Frame
208 Gypsum Panels
210 Insulation Element
212 Plane
214 Vertical Axis
216 First Axis
218 Second Axis
220 Supporting member
222 First Side
224 Second Side
226 Shelves
228 Wing
230 Wing
234 Top end of Modular Wall
236 Bottom End of Modular Wall
240 Room
242 Room
300 Support Structure
302 Rail Member
304 Overhanging Structure
306 Elongate Member
308 First End
310 Second End
312 First Flange Member
314 Second Flange Member
L1 Length
H1 Height

We claim:

1. A modular wall disposed in a room having a plurality of sidewalls including a first sidewall, a second sidewall opposing the first sidewall, and a third sidewall extending between the first sidewall and the second sidewall, the modular wall comprising:

a supporting member defining a first horizontal axis in a plane of the supporting member and a second horizontal axis perpendicular to the first horizontal axis; and a pair of wings operatively coupled to the supporting member, wherein each of the supporting member and the pair of wings comprises:

a frame; and one or more gypsum panels attached to the frame, wherein the pair of wings includes a first wing configured to move between an open position extending along a length of the first horizontal axis towards the first sidewall and a closed position away from the first sidewall, and a second wing configured to move between an open position extending along a length of the first horizontal axis towards the second sidewall and a closed position away from the second sidewall, the motion between the open position and the closed position being along a length of the first horizontal axis, and wherein the modular wall is configured to be movable between a first position proximal to the third sidewall and a second position distal from the third sidewall along a length of an axis parallel to the second horizontal axis of the modular wall when the modular wall is in the second position.

2. The modular wall of claim 1, wherein each of the wings is slidably attached to the supporting member and is configured to slide relative to the supporting member along the first horizontal axis between the open position and the closed position.

3. The modular wall of claim 1, wherein each of the wings comprises a concertina arrangement.

4. The modular wall of claim 1, wherein the supporting member comprises a plurality of shelves.

5. The modular wall of claim 1, wherein each of the supporting member and the pair of wings comprises insulation disposed between the frame and one or more gypsum panels.

6. The modular wall of claim 1, wherein the frame is made from at least one of metal, wood and plastic.

7. The modular wall of claim 1, wherein the supporting member and the pair of wings are reinforced.

8. The modular wall of claim 1, wherein the gypsum panel comprises a polymeric binder and a plurality of fibres.

9. The modular wall of claim 8, wherein the polymeric binder comprises one of a starch and a synthetic material.

10. The modular wall of claim 8, wherein the polymeric binder and the plurality of fibres, in combination, comprise greater than 1% by weight of the modular wall.

11. The modular wall of claim 8, wherein one among the polymeric binder and the plurality of fibers comprises greater than 1% by weight of the modular wall.

12. The modular wall of claim 1, comprising at least one of an MDF, a plywood, a glass, a metal, a cement, a fiber cement and a plastic sheet.

13. The modular wall of claim 1, wherein the first wing in the open position is configured to contact the first sidewall and the second wing in the open position is configured to contact the second sidewall by extending along the length of the first horizontal axis of the supporting member.

14. The modular wall of claim 1, wherein the first position is adjacent to the third sidewall.

15. A modular wall system disposed in a room having the plurality of sidewalls including a first sidewall, a second sidewall opposing the first sidewall, and a third sidewall extending between the first sidewall and the second sidewall, the room further comprising a ceiling, the modular wall system comprising:

a support structure coupled to the ceiling of the room; and a modular wall movably coupled to the support structure, the modular wall being configured to move between a first position proximal the third sidewall and a second position distal from the third sidewall along an axis parallel to the second horizontal axis of the modular wall when the modular wall is in the second position, wherein the modular wall comprises a supporting member defining a first horizontal axis in a plane of the supporting member and the second horizontal axis perpendicular to the first horizontal axis; and a pair of wings operatively coupled to the supporting member, the pair of wings including a first wing configured to move between an open position extending in a direction of the first horizontal axis towards the first sidewall and a closed position away from the first sidewall, and a second wing configured to move between an open position extending in a direction of the first horizontal axis towards the second sidewall and a closed position away from the second sidewall, wherein each of the supporting member and the pair of wings comprises:

a frame; and one or more gypsum panels attached to the frame, wherein the support structure comprises:

a rail member disposed parallel to the second horizontal axis of the modular wall when the modular wall is in the second position and fixedly coupled to the ceiling;

an elongate member of I-shape having a first end and a second end;

a first flange member coupled to the first end of the elongate member; and a second flange member coupled to the second end of the elongate member and a top end of the modular wall, wherein the first end of the elongate member is slidably coupled to the rail member through the first flange member.

16. The modular wall system of claim 15, wherein the modular wall defines a vertical axis along a height thereof, and wherein the modular wall is further configured to rotate at least partially about the first horizontal axis and completely about the vertical axis.

17. The modular wall system of claim 15, wherein the support structure comprises floor tracks disposed on a bottom end of the modular wall.

18. The modular wall system of claim 15, wherein the floor tracks are one of rails or wheels.

19. The modular wall system of claim 15, wherein the first wing in the open position is configured to contact the first sidewall and the second wing in the open position is configured to contact the second sidewall.

20. The modular wall system of claim 19, wherein each wing of the pair of wings further comprises a secondary wing movably attached thereto.

21. A modular room comprising:

a plurality of sidewalls including a first sidewall, a second sidewall opposing the first sidewall, and a third sidewall extending between the first sidewall and the second sidewall;

at least one modular wall comprising:

a supporting member defining a first horizontal axis in a plane of the supporting member and a second horizontal axis perpendicular to the first horizontal axis; and a pair of wings operatively coupled to the supporting member, the pair of wings including a first wing configured to move between an open position extending in a direction of the first horizontal axis towards the first sidewall and a closed position away from the first sidewall, and a second wing configured to move between an open position extending in a direction of the first horizontal axis towards the second sidewall and a closed position away from the second sidewall;

wherein each of the supporting member and the pair of wings comprises:

a frame, and one or more gypsum panels attached to the frame;

a ceiling disposed on the plurality of sidewalls; and a support structure coupled to a ceiling of the room, the support structure comprising:

a rail member disposed parallel to the second horizontal axis when the modular wall is in the second position and coupled to the ceiling;

an elongate member of I-shape having a first end and a second end, the first end slidably disposed in the rail member;

a first flange member coupled to the first end of the elongate member; and a second flange member coupled to the second end of the elongate member and a top end of the modular wall, wherein the at least one modular wall is slidably coupled to the rail member such that the modular wall is configured to move between a first position proximal to the third sidewall and a second position distal from/to the third sidewall when the modular wall is in the second position; and wherein the plurality of sidewalls, the at least one modular wall in the second position and the pair of wings in the open position are configured to form at least two rooms within the modular room.

22. The modular room of claim 21, wherein at least one of the two divided rooms is a closed room.

* * * * *